US007264114B2

(12) United States Patent
Daniel

(10) Patent No.: US 7,264,114 B2
(45) Date of Patent: Sep. 4, 2007

(54) CARTON WITH TOP RETAINING STRUCTURE AND BLANK THEREFOR

(75) Inventor: Jean Yves Daniel, Chateauroux (FR)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 115 days.

(21) Appl. No.: 10/780,776

(22) Filed: Feb. 17, 2004

(65) Prior Publication Data

US 2004/0226833 A1 Nov. 18, 2004

Related U.S. Application Data

(63) Continuation of application No. PCT/US02/26326, filed on Aug. 19, 2002.

(30) Foreign Application Priority Data

Aug. 17, 2001 (GB) ..... 0120132.6

(51) Int. Cl.
*B65D 75/00* (2006.01)

(52) U.S. Cl. ..... 206/152; 206/157; 206/158; 206/434

(58) Field of Classification Search ..... 206/145, 206/147, 148, 149, 152, 153, 155, 157, 160, 206/161, 427, 434, 158; 294/87.2
See application file for complete search history.

(56) References Cited

U.S. PATENT DOCUMENTS 3,156,358 A * 11/1964 Randrup ..... 206/153
3,157,309 A 11/1964 Chidsey, Jr. et al.
3,698,550 A 10/1972 Graser
3,722,945 A 3/1973 Wood
3,767,041 A 10/1973 Graser
3,897,873 A * 8/1975 Graser ..... 206/153
4,188,766 A 2/1980 Culpepper
4,192,540 A 3/1980 Oliff
4,489,880 A 12/1984 Calvert
5,845,776 A * 12/1998 Galbierz et al. ..... 206/153
6,223,892 B1 5/2001 Bakx

FOREIGN PATENT DOCUMENTS

DE 3428634 A1 2/1986
EP 1015347 B1 2/2003
GB 1004118 9/1965
GB 2100217 A 12/1982
WO 98/49071 A 11/1998

* cited by examiner

*Primary Examiner*—Luan K. Bui
(74) *Attorney, Agent, or Firm*—Tsugihiko Suzuki

(57) ABSTRACT

A carton and blank for forming a carton of the top gripping type for accommodating a plurality of containers. The carton is tubular in structure and has top and base spaced, opposed panels. The base panel has apertures each for receiving a container. The base panel also has a foldable retaining tab hingedly connected thereto for operatively engaging part of the respective container. The carton also has a retaining structure depending from the top panel. The retaining structure comprises an engagement panel with an engaging edge to engage at least one of the containers.

17 Claims, 4 Drawing Sheets

CARTON WITH TOP RETAINING STRUCTURE AND BLANK THEREFOR

This is a continuation of international application No. PCT/US02/26326, filed Aug. 19, 2002, which is hereby incorporated by reference.

BACKGROUND OF THE INVENTION

The invention relates to a carton produced for packaging a plurality of articles, for example, bottles. More particularly, the invention relates to a carton, which attaches to the tops of the articles thereby securing the articles in an array.

It is known to provide top gripping cartons which comprise so called "sunburst" apertures having a series of circumferentially arranged tabs which enable a bottle top to pass through the aperture which tabs engage on the underside of a bottle top or on the flange of a bottle neck to prevent the removal of the bottle from the aperture. A problem arises when such sunburst type apertures are used for bottles sealed using so called "crown corks". In this case, the location in which the tab engages on the underside of the bottle top is by its location high up the bottleneck, which creates a carton that is unstable.

Further, the tabs are weakened by the unstable nature of the bottles within the carton so reducing its effectiveness.

In U.S. Pat. No. 3,722,945 there is shown a carton with a top panel comprising retaining tabs to support the upper part of an article contained in the carton.

Another example is illustrated in EP 98918290.2 in which there is shown a carton of the top gripping type for accommodating a plurality of containers, for example, bottles, which carton is tubular in structure and comprises a first panel having a plurality of apertures, each has at least one foldable tab which operatively engages the underside of a radially protruding part of a container present in the aperture and a second panel spaced from the first panel and comprising a retaining tab struck from said second panel, said retaining tab comprising a main portion and a shoulder portion wherein an edge of said shoulder portion also operatively engages the underside of said radially protruding part to restrict movement of said second panel relative to upper portions of the container, said main portion being disposed between a pair of adjacent containers to minimize relative movement between those containers.

One problem with this approach is that a complicated folding arrangement is required to fold the retaining tabs.

A further problem associated with the prior art is that a top-gripping carton needs to be of sufficient strength to support the bottles. A rigid structure would address this problem but produces its own difficulties. In particular, the top panel and/or base panel does not provide requisite rigidity and sufficient strength to support the bottles.

The present invention and its preferred embodiments seek to overcome the difficulties of the prior art by forming a box structure in which both the top and base are engaged on the bottle flanges and which is simple to construct. Additional support is provided to maintain the top and base panels in a spaced arrangement while additional strength is provided by multi-layering the panels. Therefore, the board can be reduced in thickness without reducing the strength needed to hold the bottles.

SUMMARY OF THE INVENTION

One aspect of the invention provides a carton of the top gripping type for accommodating a plurality of containers, which carton is tubular in structure and comprises first and second spaced panels. The first panel has one or more apertures each for receiving a container, and a foldable retaining tab hingedly connected to the first panel for operatively engaging part of a respective one of the containers. There further comprises a top-retaining structure depending from the second panel, the retaining structure comprising an engagement panel with an engaging edge to engage the one of the containers and/or the at least one retaining tab to restrict movement of the second panel relative to the first panel.

Preferably each aperture may be defined by a pair of the retaining tabs struck from the first panel, the retaining tabs being disposed in substantially opposed positions.

According to an optional feature of this aspect of the present invention, at least one of the retaining tabs may have a shallow notch for receiving the engaging edge of the panel to allow the edge to reach the radially protruding part of the one container.

According to a second optional feature of this aspect of the present invention the retaining structure may be provided with an opening for receiving part of the container, the engaging edge may be formed from an edge of the opening. Preferably, the engagement flap may have an engaging tab projecting into the opening and wherein the engaging tab may comprise the engaging edge.

According to another optional feature of this aspect of the present invention, the engaging edge may be spaced from the top panel.

According to a further optional feature of this aspect of the present invention, the engagement panel may be disposed between the one container and an adjacent container to minimize relative movement between the one and adjacent containers. Preferably, the retaining structure may further comprise a connector panel for hingedly connecting the engagement panel to the second panel.

A second aspect of the invention provides a tubular top-gripping carton having a top panel including inner and outer overlapping panel portions, wherein a retaining structure depends from the inner panel portion to engage the underside of a radially protruding part of a necked article. The retaining structure has an opening for receiving at least a portion of the radially protruding part of the article, and a lower edge of the opening comprises an engaging edge for the underside of the radially protruding part.

Preferably the retaining structure may include a connector panel hingedly connected to and extending downwardly from the free edge of the inner panel portion and an engagement panel hingedly connected to the lower edge of the connector panel, and the opening may be formed at least in part in the connector panel.

More preferably, the engagement panel may have an engaging tab projecting into the opening, and wherein the engaging tab may comprise the engaging edge.

A third aspect of the invention provides the tubular top-gripping carton for a plurality of articles, for example bottles, the carton having a top panel including a pair of inner and outer lap panel portions, wherein a retaining structure depends from the inner panel portion, and wherein the retaining structure comprises a spacer strip disposed between adjacent rows of articles, the strip having one side edge for engagement with the articles in one row and the other side edge for engagement with the articles in the other row.

Preferably, the retaining structure may further comprise a connector panel extending downwardly from the free edge of the inner lap panel portion, the connector panel being hingedly connected at its lower edge to a part of the one side edge of the spacer strip.

A fourth aspect of the invention provides a unitary blank for forming a carton of a top gripping type comprising a plurality of panels for forming a tubular structure including a first panel having a plurality of apertures each defined in part by a foldable retaining tab hingedly connected to the first panel to be folded out of a general plane of the first panel, and a second panel spaced from the first panel by an intermediate panel and a retention structure depending from the second panel, the retention structure having an opening for receiving at least a portion of the radially protruding part of the article in a set up condition, and a lower edge of the opening comprises an engaging edge for engaging the underside of the radially protruding part.

A fifth aspect of the invention provides a package comprising at least one container each including a substantially cylindrical upper portion and a part radially protruding from the upper portion; and a tubular top-gripping carton of the top gripping type for accommodating a plurality of containers, which top-gripping carton having a top panel including inner and outer overlapping panel portions and a base having an aperture for receiving a container, at least one foldable retaining tab connected to the first panel for operatively engaging a radially protruding part of the container, wherein a retaining structure depends from the inner panel portion to engage the underside of a radially protruding part of a necked article and/or the one or more retaining tab, the retaining structure has an opening for receiving at least a portion of the radially protruding part of the article, and a lower edge of the opening comprises an engaging edge for the underside of the radially protruding part and/or the tab(s).

Preferably the retaining structure may include a connector panel hingedly connected to and extending downwardly from the free edge of the inner panel portion and an engagement panel hingedly connected to the lower edge of the connector panel, and the opening may be formed at least in part in the connector panel.

Preferably, the engagement panel may have an engaging tab projecting into the opening, and wherein the engaging tab may comprise the engaging edge. More preferably, the engagement panel may be disposed between the one container and an adjacent container to minimize relative movement between the one and adjacent containers.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENT

Figure 1:
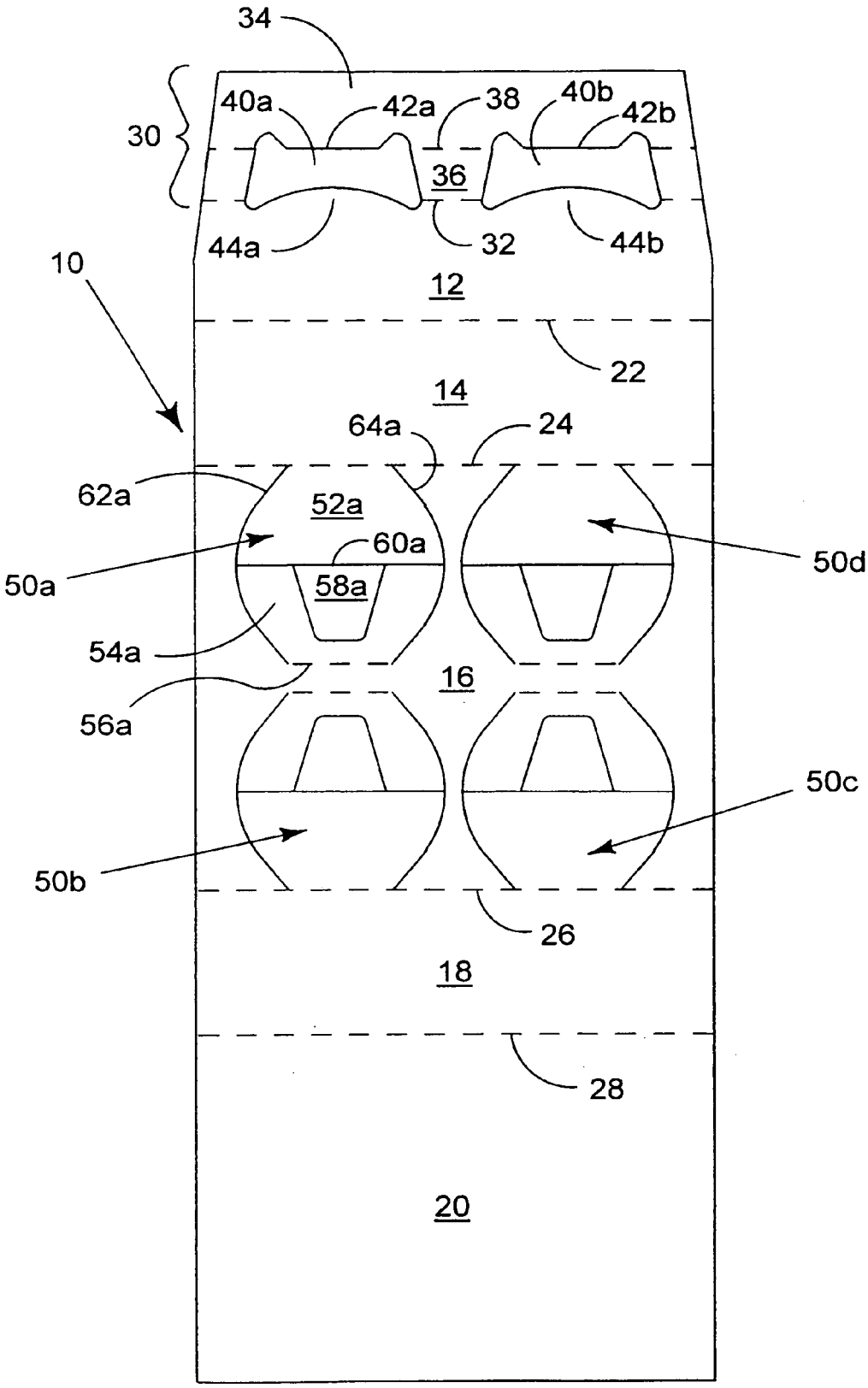
FIG. 1 is a plan view of an unfolded single paperboard blank from which a carton according to one embodiment of the invention is formed.

Referring to the drawings and, in particular, FIG. 1, there is shown a blank 10 for forming a carton made from paperboard or like foldable sheet material. In this embodiment, there comprises a unitary blank although it is envisaged that two or more blanks can be used, without departing from the scope of invention. The blank 10 comprises a plurality of panels for forming a tubular carton of the top-gripping type. Thus, there comprises an inner top panel portion 12, a first side panel 14, base panel 16, second side panel 18 and an outer top panel portion 20 hingedly connected one to the next in series along fold lines 22, 24, 26 and 28 respectively.

There further comprises a retention structure 30 for retaining the one or more adjacent articles and to support the top and base panels in a spaced arrangement while additional strength is provided by multi-layering the panels engaging the articles. In this embodiment, retention structure 30 is hingedly connected to inner top panel portion 12 along fold line 32. It is envisaged that the retention structure could be formed from a separate blank, which is secured or hinged to the outer blank.

Turning to the construction of the retention structure 30, it has one or more openings 40*a*, 40*b* for receiving part of an article, described in more detail below. Preferably, the or each opening comprises an engaging edge 42*a*, 42*b* for engaging part of the article. In some embodiments an engaging tab is provided, which tab extends into the opening and provides the engaging edge.

In this embodiment, the retention structure is formed by a connector panel 36 which is hingedly connected to the inner top panel portion 12 and an engagement panel 34 hingedly connected to the opposing edge of the connector panel 36. Two openings 40*a* and 40*b* are struck at least in part from the connector panel 36, and optionally, extend into the engagement panel 34.

There further comprises one or more retaining tabs 50 struck from base panel 16. Each retaining tab 50 is used to engage part of an article as described in more detail.

Turning in detail to the configuration of one pair of retaining tabs 50*a*, there comprises tab 52*a* struck from and hingedly connected to base panel 16 along fold line 24 with its distal edge extending inwardly of base panel 16. Tab 52*a* comprises opposed side edges 62*a*, 64*a* which may curve outwardly to the distal edge 52, so that the distal edge 52 is longer than the edge connected to base panel 16, thereby to improve engagement with the article.

A second tab 54*a* is hingedly connected to base panel 16 along fold line 56*a*, preferably positioned in a central region of base panel 16. Tab 54*a* is oppositely disposed to tab 52*a* with its distal edge 60*a* juxtaposed the distal edge of tab 52*a*. Likewise, the side edges curved outwardly towards its distal edge 64. Tabs 52*a* and 54*a* respectively define an aperture 70, shown in FIG. 2, when the tabs 52, 54 are in a set up condition.

In one class of embodiments, there may further comprise an elongate recess 58*a* struck from the central portion of one or more tabs 52 and 54 to provide a small notch along each of their respective distal edges.

The other pairs of retaining tabs 50*b*, 50*c*, and 50*d* are substantially identical to the first pair of retaining tabs 50*a* and are not therefore described in any greater detail.

Figure 2:
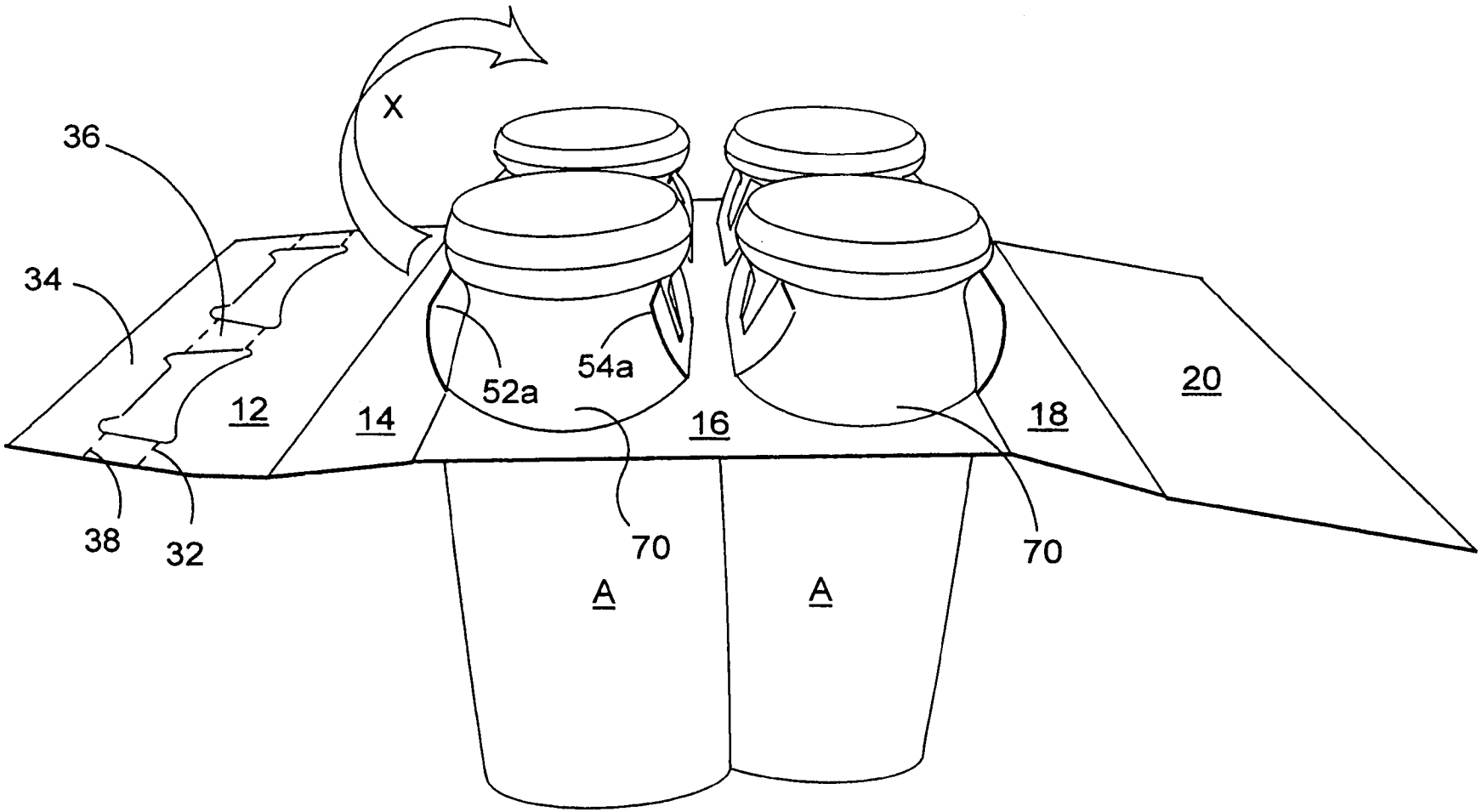
FIG. 2 is a perspective view, illustrating a condition wherein the blank of FIG. 1 is being applied to a group of bottles to form a package according to the one embodiment of the invention.
Figure 3:
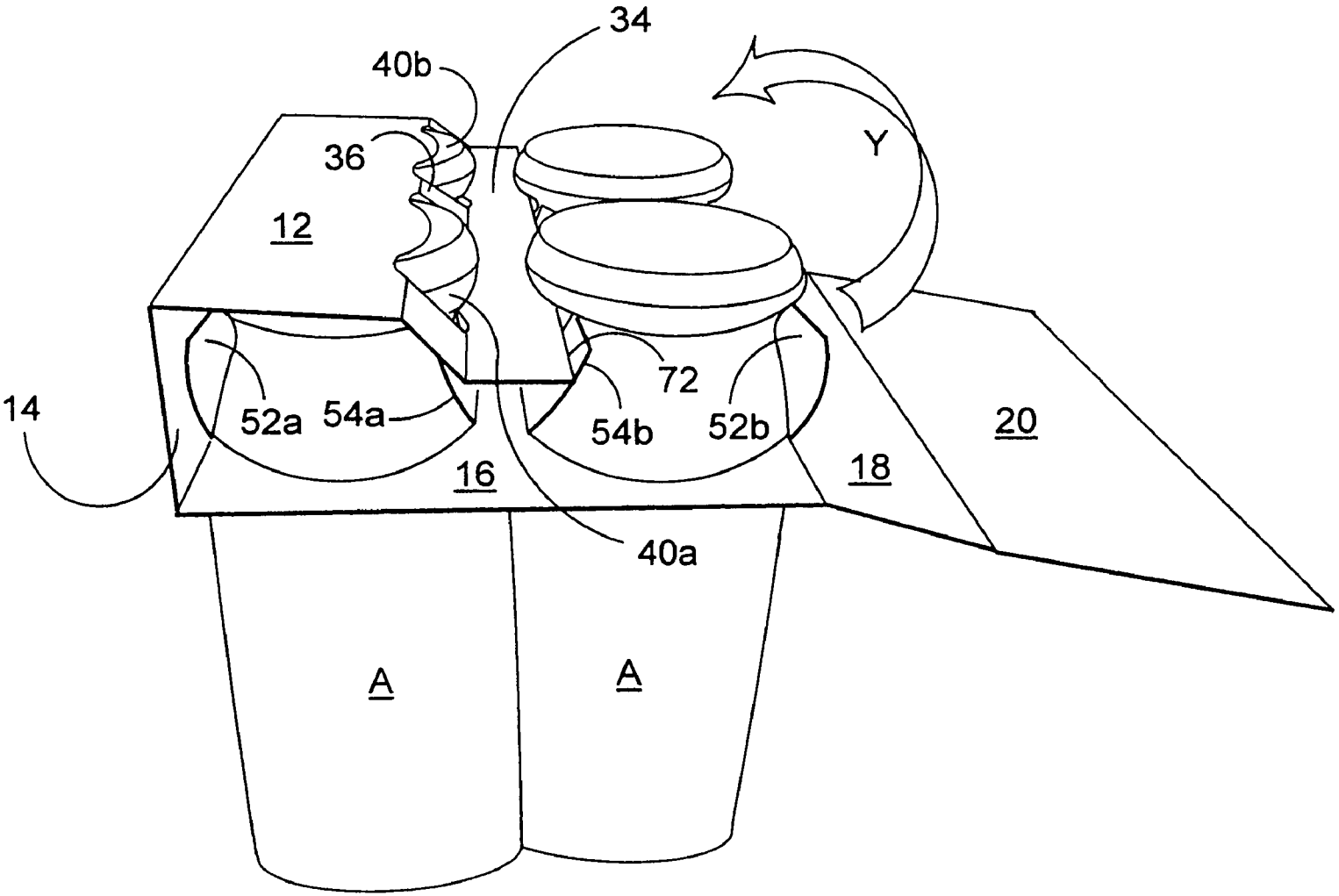
FIG. 3 is a perspective view, illustrating a package in part formed condition from the carton blank shown in FIG. 2.
Figure 4:
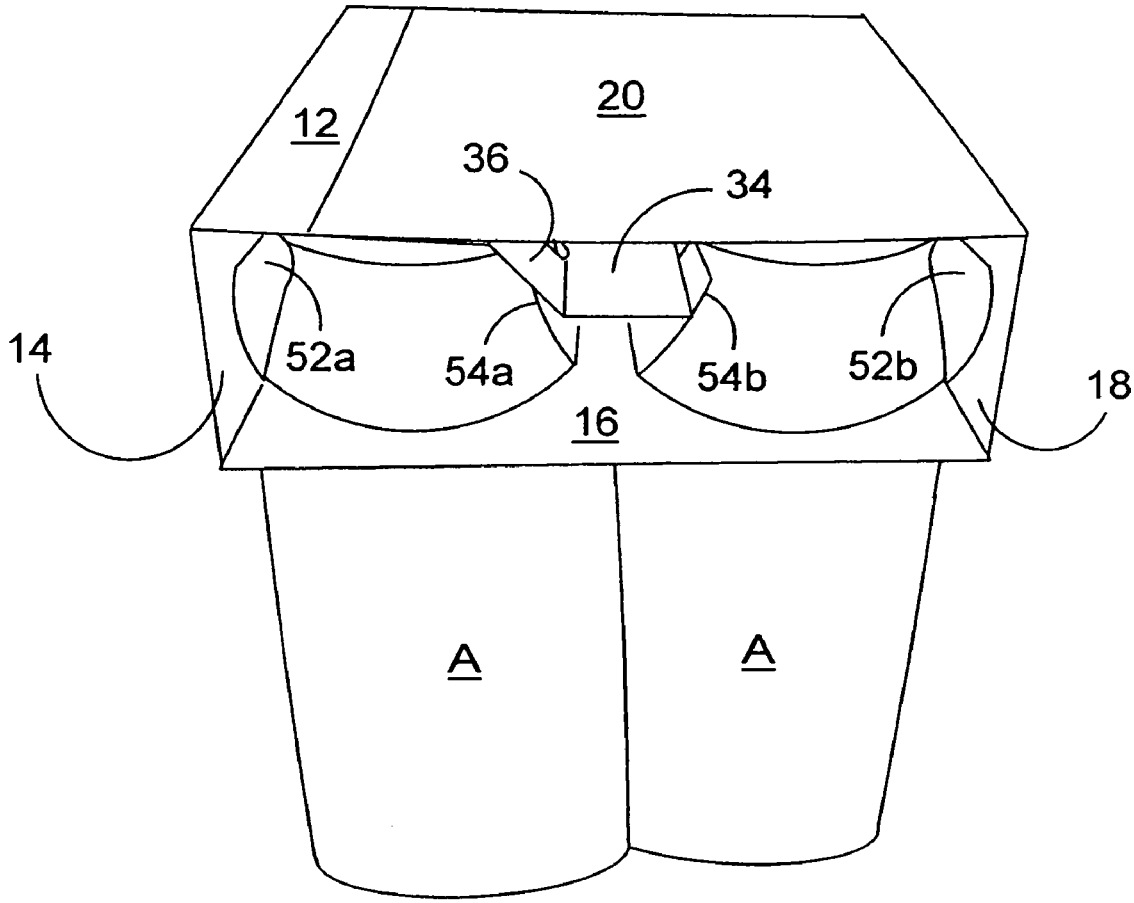
FIG. 4 shows a complete package formed from the blank shown in FIG. 2.

Turning to the construction of carton, as illustrated in FIGS. 2, 3 and 4, the blank requires a series of sequential folding and gluing operations which can be performed in a straight line machine so that the carton is not required to be rotated or inverted to complete its construction. The folding process is not limited to that described below and can be altered according to particular manufacturing requirements.

A plurality of articles "A" are grouped together in an array. In this embodiment there are two rows of two bottles "A" each and the blank 10 is introduced to the group from above by relative vertical movement between the bottles "A" and the blank 10 during continuous forward feed movement well known in the art.

Each pair 50*a*, 50*b*, 50*c* and 50*d* of retaining tabs 52*a* and 54*a* are folded along their respective fold lines 24, 56*a* and out of their general plane with respect to base panel 16 to create article receiving apertures 70, shown in FIG. 2. The upper portions or neck portions of the bottles enter their respective apertures until the distal edges 60*a* of the retaining tabs 52*a*, 54*a* come into contact with the article, for example radially protruding parts of the respective crown corks, or the bottles "A" associated within each of the apertures. Optionally, the edge of each article receiving apertures is in contact with the neck portion of each of the respective bottles "A" to provide additional support.

In this embodiment, the notch 58*a* formed in the distal edge of each of the tabs 54*a* engages the underside of the respective article "A". It is advantageous to incorporate such notches for more accurate alignment of the tabs and/or to provide a tab, which comes into contact with more of the underside of the article than conventional tabs.

Side panel 14 is folded about fold line 24 and inner top panel portion 12 is folded about fold line 22 in direction X so that inner top panel portion 12 is disposed over the tops of the adjacent articles and in a substantially parallel and spaced relationship with base panel 16.

Thereafter, retention structure 30 is formed. As shown in FIG. 3, the connector panel 36 and engagement panel 34 are folded out of alignment with respect to the inner top panel portion 12 to reveal the openings 40*a* and 40*b*, whereby protruding parts of the articles enter the openings and are engaged by the engaging edges 42*a* and 42*b*. The engagement panel 34 is pushed under the protruding part of the adjacent articles as shown in FIG. 3 so that the free end edge 72 engages the adjacent article.

In one class of embodiments the engaging edges 42*a* and 42*b* and end edge 72 abut the inner retaining tabs 54*a* and 54*b* to hold them in position. Furthermore, the engagement panel 34 functions as a brace to introduce rigidity to the carton and to reduce movement between adjacent articles. In some embodiments, the engagement panel 34 is sized to form an interference fit between adjacent articles "A".

Side panel 18 is folded about fold line 26 and outer top panel portion 20 is folded about fold line 28 in direction Y such that outer top panel portion 20 is placed in a face to face relationship with inner top panel portion 12. Inner and outer top panel portions 12, 20 are secured together by glue or other securing means known in the art.

The carton is in a set up condition as shown in FIG. 4 which shows a tubular top-gripping carton having a top panel including inner and outer overlapping panel portions 12, 20, wherein a retaining structure 30 depends from the inner top panel portion 12 to engage the underside of a radially protruding part of a necked article A, the retaining structure 30 has an opening 40*a* for receiving at least a portion of the radially protruding part of the article, and a lower edge of the opening 40*a* comprises an engaging edge 42*a* for engaging the underside of the radially protruding part.

It will be recognized that as used herein, directional references such as "top", "base", "end", "side", "inner", "outer" "first" and "second" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

It should be recognized that numerous changes may be made within the scope of the invention. In particular, it should be apparent to a person skilled in the art that the retention arrangements described above may be applied to a wide variety of carton types, for example wraparound cartons, top gripping cartons and other such clips, in which it is necessary for articles to be packaged having flange portions to be retained without the use of glue or other known means. The position of the retention structure or clip may be adjusted to accommodate articles having flanges at locations other than at the ends of the carton.

What is claimed is:

1. A carton for accommodating a plurality of containers, the carton being of a tubular structure and comprising top and base spaced opposed panels, the top panel including inner and outer overlapping panel portions, and a retaining structure depending from the inner panel portion of the top panel, the retaining structure comprising an engagement panel spaced below the outer panel portion with an engaging edge to engage a container and a connector panel extending downward from a free edge of the inner panel portion and hingedly connected at a lower edge of the connector panel to the engagement panel, wherein the retaining structure is provided with at least one opening each for receiving part of a container, the engaging edge being provided by an edge of the at least one opening, the retaining structure being disposed in the tubular structure such that the at least one opening as a whole is disposed directly below the outer panel portion.

2. The carton according to claim 1 wherein the base panel has apertures each defined for receiving a container, and the base panel is provided with at least one foldable retaining tab hingedly connected thereto for operatively engaging part of a container.

3. The carton according to claim 2 wherein the engaging edge is arranged to press the at least one retaining tab against a container to retain the at least one retaining tab in engagement with a container.

4. The carton according to claim 2 wherein each of the apertures is defined by a pair of the retaining tabs struck from the base panel, the retaining tabs of each pair being disposed in substantially opposed positions.

5. The carton according to claim 2 wherein the at least one retaining tab has a notch for receiving the engaging edge of the engagement panel to allow the engaging edge to reach a radially protruding part of a container.

6. The carton according to claim 1 wherein the engagement panel has an engaging tab projecting into the each opening and wherein the engaging tab comprises the engaging edge.

7. The carton according to claim 1 wherein the engagement panel is spaced above the base panel.

8. The carton as claimed in claim 1 wherein the inner and outer panel portions are disposed in substantially the same plane.

9. The carton as claimed in claim 1 wherein a free edge of the outer panel portion is disposed on the inner panel portion such that the free edges of the inner and outer panel portions lie in substantially the same plane.

10. A carton for accommodating a plurality of containers, the carton being of a tubular structure and comprising top and base spaced opposed panels, the top panel including inner and outer overlapping panel portions, and a retaining structure depending from the inner panel portion of the top panel, the retaining structure comprising an engagement panel with an engaging edge to engage a container and a connector panel extending downward from a free edge of the inner panel portion and hingedly connected at a lower edge of the connector panel to the engagement panel, wherein the retaining structure is provided with at least one opening each for receiving part of a container, the engaging edge being provided by an edge of the at least one opening, the retaining structure being disposed in the tubular structure such that the at least one opening as a whole is disposed directly below the outer panel portion;

wherein the engagement panel is disposed between a first container and a second adjacent container to have opposed side edges thereof engaged with the first and second containers respectively, one of said opposed side edges being defined in part by said engaging edge.

11. A package comprising a carton of a tubular structure and a necked article contained in the carton, the carton comprising a top panel including inner and outer overlapping panel portions disposed in substantially the same plane, and a retaining structure depending from the inner panel portion to engage an underside of a radially protruding part of the necked article, wherein the retaining structure includes a connector panel hingedly connected to and extending downwardly from a free edge of the inner panel portion and an engagement panel hingedly connected to a lower edge of the connector panel, the retaining structure has an opening for receiving a portion of the radially protruding part of the article, the opening is formed at least in part in the connector panel, and a lower edge of the opening comprises an engaging edge for engaging the underside of the radially protruding part, the retaining structure being disposed in the tubular structure such that the opening is disposed directly below the outer panel portion.

12. The package as claimed in claim 11 wherein the engagement panel has an engaging tab projecting into the opening, and wherein the engaging tab comprises the engaging edge.

13. A package comprising a top-gripping carton and a plurality of articles arranged in at least two rows and engaged by the carton, the carton comprising a top panel including a pair of inner and outer lap panel portions, and a retaining structure depending from the inner panel portion, wherein the retaining structure comprises a spacer strip disposed between two adjacent ones of the rows of the articles, the strip having one side edge for engagement with the articles in one of the adjacent rows and the other side edge for engagement with the articles in the other of the adjacent rows, wherein the retaining structure further comprises a connector panel extending downwardly from a free edge of the inner lap panel portion, the connector panel being hingedly connected at a lower edge thereof to the one side edge of the spacer strip.

14. A unitary blank for forming a carton, comprising a plurality of panels connected together in series to form a tubular structure including a base panel having a plurality of apertures each defined in part by a foldable retaining tab hingedly connected to the base panel to be folded out of a general plane of the base panel, an inner top panel portion spaced from the base panel by a first side panel, a retaining structure formed on another panel and connected to the inner top panel portion connected to the inner panel portion, an outer top panel portion connected to the base panel by a second side panel to be secured directly to the inner top panel portion when the carton is formed, the retaining structure having a void defining an opening for receiving at least a portion of a radially protruding part of an article in a set up condition, and a lower edge of the opening comprises an engaging edge for engaging an underside of the radially protruding part, the outer top panel portion defining one of opposed ends of the blank.

15. A carton for accommodating a plurality of containers, the carton being of a tubular structure and comprising top and base spaced opposed panels, the top panel including inner and outer overlapping panel portions, and a retaining structure disposed inside the tubular structure, the retaining structure comprising a connector panel extending downward from the inner panel portion and an engagement panel hingedly connected to a lower edge of the connector panel, the engagement panel being disposed between a first container and a second adjacent container to have the opposed side edges thereof engaged with the first and second containers respectively.

16. The carton as claimed in claim 15 wherein the retaining structure is provided with an opening for receiving part of the fist container, one of the opposed side edges of the engagement panel being defined in part by an edge of the opening of the retaining structure.

17. The carton as claimed in claim 16 wherein the connector panel is hingedly connected to a free edge of the inner panel portion, said one of the opposed side edges of the engagement panel is hingedly connected to the lower edge of the connector panel, and a free edge of the outer panel portion being disposed on the inner panel portion such that the free edges of the inner panel portions lie in substantially the same plane.

* * * * *